US010758770B2

(12) United States Patent
Gilman

(10) Patent No.: US 10,758,770 B2
(45) Date of Patent: Sep. 1, 2020

(54) TRAINING DEVICES AND METHODS

(71) Applicant: Marty Gilman, Inc., Gilman, CT (US)

(72) Inventor: Neil F. Gilman, Gilman, CT (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

(21) Appl. No.: 15/807,381

(22) Filed: Nov. 8, 2017

(65) Prior Publication Data

US 2019/0111304 A1 Apr. 18, 2019

Related U.S. Application Data

(63) Continuation-in-part of application No. 29/622,023, filed on Oct. 13, 2017.

(60) Provisional application No. 62/573,680, filed on Oct. 17, 2017, provisional application No. 62/572,349, filed on Oct. 13, 2017.

(51) Int. Cl.

| | |
|---|---|
| ***A63B 21/06*** | (2006.01) |
| ***A63B 21/00*** | (2006.01) |
| ***A63B 5/16*** | (2006.01) |
| ***A63B 23/04*** | (2006.01) |
| ***A63B 5/22*** | (2006.01) |
| ***A63B 71/02*** | (2006.01) |
| ***A63B 69/00*** | (2006.01) |

(52) U.S. Cl.

CPC ..... *A63B 21/0601* (2013.01); *A63B 5/16* (2013.01); *A63B 5/22* (2013.01); *A63B 21/4023* (2015.10); *A63B 21/4035* (2015.10); *A63B 21/4041* (2015.10); *A63B 23/0405* (2013.01); *A63B 69/0028* (2013.01); *A63B 69/0071* (2013.01); *A63B 2071/026* (2013.01); *A63B 2209/00* (2013.01); *A63B 2209/14* (2013.01)

(58) Field of Classification Search

CPC ..... A63B 21/06–08

See application file for complete search history.

(56) References Cited

U.S. PATENT DOCUMENTS

| | | | | |
|---|---|---|---|---|
| 2,586,283 | A | 2/1952 | Wynn | |
| 2002/0086776 | A1 | 7/2002 | Fields et al. | |
| 2014/0309089 | A1* | 10/2014 | Buikema | A63B 21/065 482/105 |
| 2015/0165258 | A1* | 6/2015 | Januszek | A63B 21/06 482/93 |
| 2017/0128809 | A1 | 5/2017 | Adkisson | |
| 2018/0015318 | A1* | 1/2018 | Nelson | A63B 21/0601 |

FOREIGN PATENT DOCUMENTS

| | | | |
|---|---|---|---|
| AU | 2004200051 | A1 | 7/2005 |
| GB | 2477525 | A | 8/2011 |
| WO | WO2014083506 | A1 | 6/2014 |

OTHER PUBLICATIONS

"Tyre Stacking Strength Challenge." YouTube, Fitness Hall of Fame, Jan. 5, 2013, www.youtube.com/watch?v=0gl_bcxQKYQ.*

New England Foam, 3 pgs, Oct. 26, 2015; downloaded from the web on Apr. 20, 2017 (https://web-beta.archive.org/web/2010/http://usa.rhinorugby.com:80/rhino-rugby-senior-tacle-ring.).

Rhino Tackle Bags, 8 pgs, Sep. 10, 2015; downloaded from the web on Apr. 20, 2017 (https://web-beta.archive.org/web/20101026155021/http://www.newenglandfoam.com/polyether.html.).

* cited by examiner

*Primary Examiner* — Jennifer Robertson

(74) *Attorney, Agent, or Firm* — Winthrop & Weinstine, P.A.

(57) ABSTRACT

The disclosure provides embodiments of a training device and related methods of use.

20 Claims, 16 Drawing Sheets

FACE VIEW

FACE VIEW

SIDE VIEW

TRAINING DEVICES AND METHODS

CROSS-REFERENCE TO RELATED APPLICATION

The present patent application claims the benefit of priority to U.S. Provisional Patent Application Ser. No. 62/572,349, filed Oct. 13, 2017, and U.S. Provisional Patent Application Ser. No. 62/573,680, filed Oct. 17, 2017. This patent application is also a continuation-in-part of and claims the benefit of priority to U.S. patent application Ser. No. 29/622,023, filed Oct. 13, 2017. The present patent application is also related to U.S. patent application Ser. No. 15/695,412, filed Sep. 5, 2017, and U.S. patent application Ser. No. 15/065,369, filed Mar. 9, 2016. Each of the aforesaid patent applications is incorporated by reference herein in its entirety for any purpose whatsoever.

FIELD

The present disclosure relates to athletic training equipment.

BACKGROUND

The present disclosure provides improvements over the state of the art, as set forth herein.

SUMMARY

Plyometrics, also known as "jump training" or "plyos", are exercises in which muscles exert maximum force in short intervals of time, with the goal of increasing power (speed-strength). This training focuses on learning to move from a muscle extension to a contraction in a rapid or "explosive" manner, such as in specialized repeated jumping. Plyometrics are primarily used by athletes, especially martial artists, sprinters and high jumpers, to improve performance, and are used in the fitness field to a lesser degree. These types of exercises are facilitated by use of a heavy duty so-called "pylo box" which is used as a platform to jump on to or off of.

In recent years, with regard to other training philosophies, the popularity of using strongman training (especially the use of large tires), has exploded with many coaches and athletes incorporating the various exercises into their programming. When performing the various tire movements correctly, they can enhance the strength, power development, and conditioning of anyone willing to challenge themselves.

Applicant has come to appreciate that the state of the art has deficiencies. For example, Applicant has come to appreciate that truck or irrigation tires that are of a suitable size for flipping do not come in a range of weights, and it is not easy or convenient to add weight to a tire. Moreover, many tires are too large for flipping, and are too heavy. For example, a 66 inch diameter agricultural tire can easily weigh in excess of seven hundred pounds, and can cost several thousand dollars. Moreover, Applicant appreciated that such tires can scratch polished wooden gymnasium floors. Applicant further appreciated that so-called Pylo boxes can also scratch floors unless adequately padded, and they tend to be rather heavy because they need to stand up to a great deal of abuse.

Thus, Applicant provides herein embodiments of a training wheel that overcome the deficiencies in the art set forth above that are not designed for nor intended in use for tackling. Particular implementations of the wheel are preferably weighted so as to be heavier than an agricultural tire of similar diameter, but have a non-marking surface so as to be suitable for use on highly polished gymnasium floors. Moreover, implementations of the training wheel are also preferably made from a resilient material that, while not especially hard, does not deflect significantly, thus permitting use of the training wheel as a substitute for a pylo box. Being round, the wheel can be rolled to a desired location and used for any desired drill in any desired sport, whether it be indoors or outdoors. These and other advantages of the disclosed embodiments, and illustrated methods of use, are set forth herein below.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

DETAILED DESCRIPTION

Description will now be given of the invention with reference to the attached FIGS. 1-20. It should be understood that these figures are exemplary in nature and in no way serve to limit the scope of the invention as the invention will be defined by the claims, as interpreted by the Courts in an issued U.S. Patent.

Figure 1:
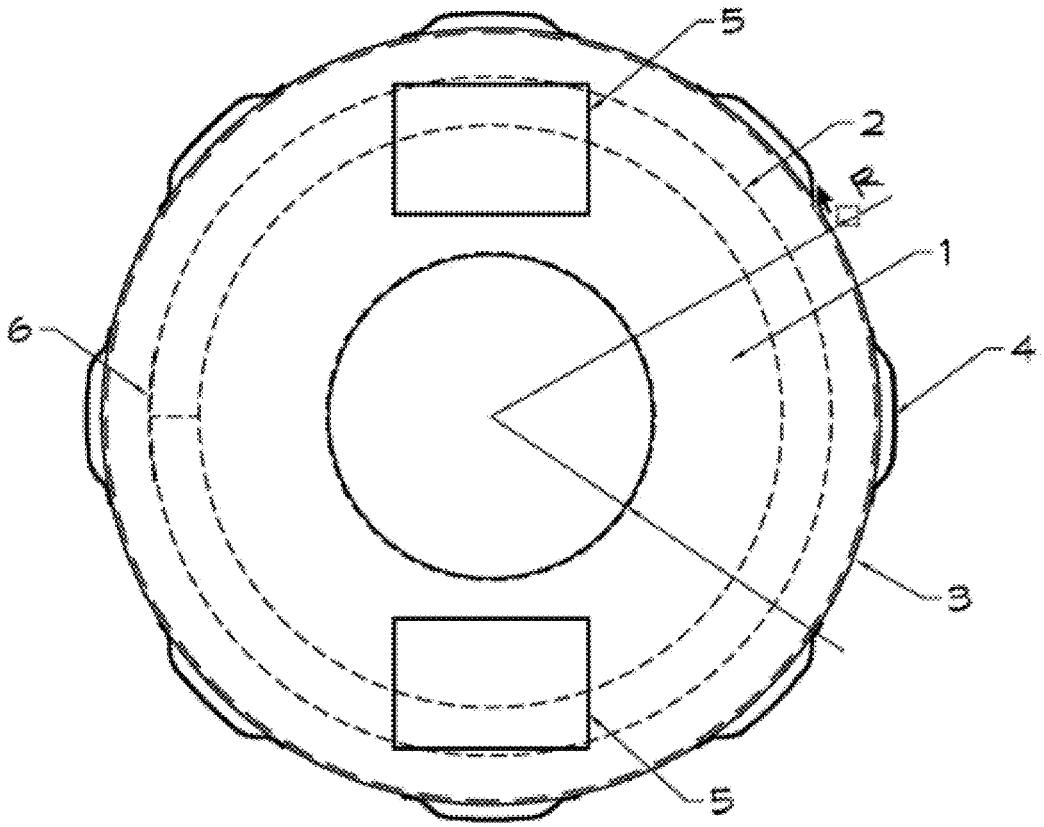
FIG. 1 is a front view of a FUNCTIONAL TRAINING RING in accordance with the disclosure.
Figure 2:
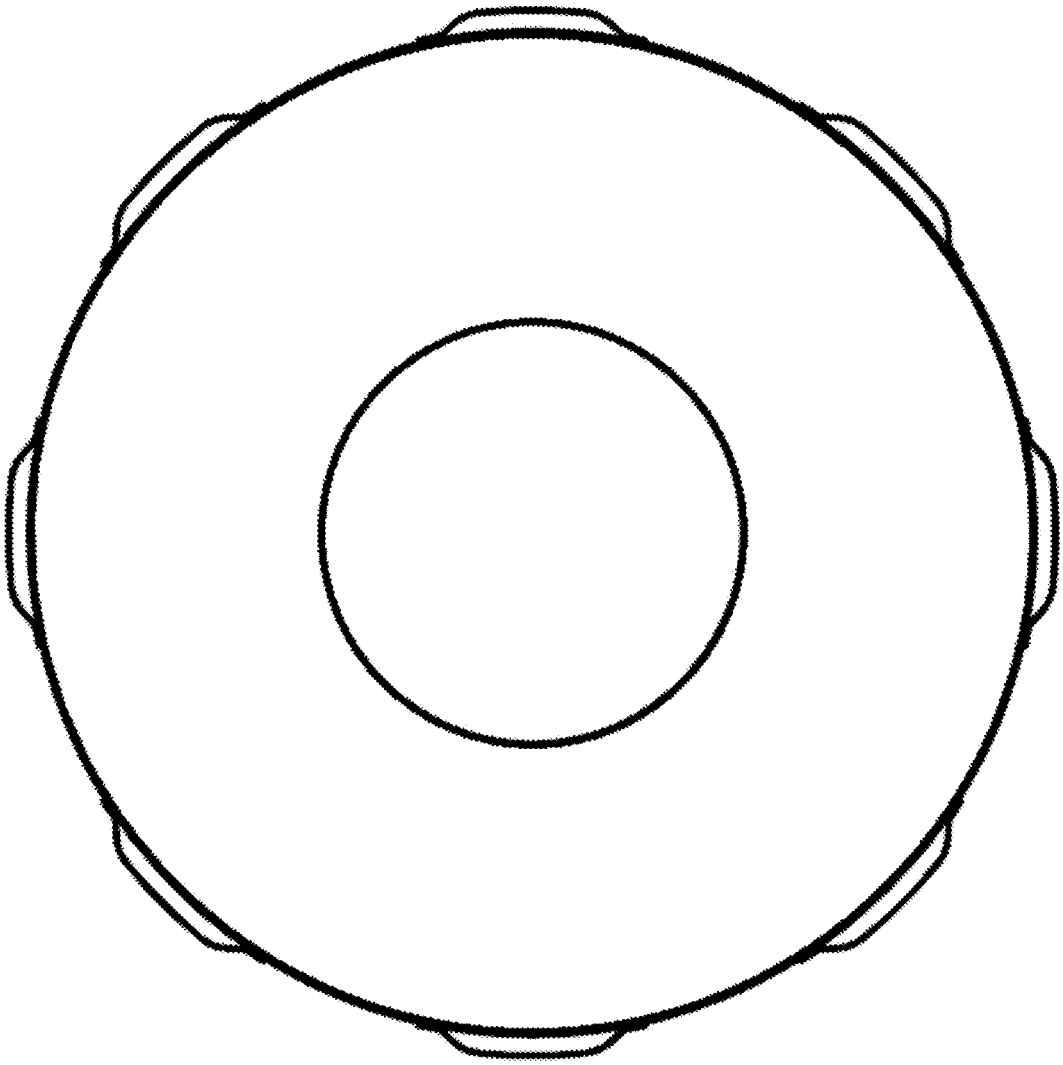
FIG. 2 is a rear view thereof.
Figure 3:
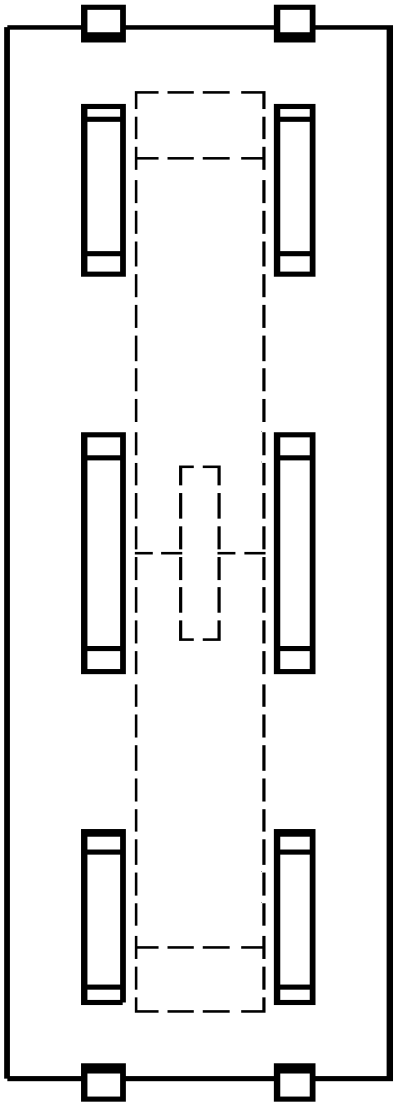
FIG. 3 is a left side view thereof.
Figure 4:
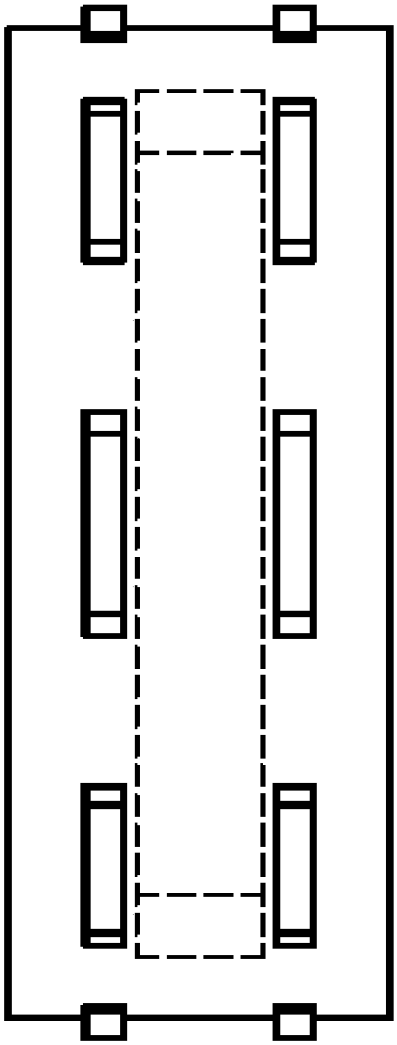
FIG. 4 is a right side view thereof.
Figure 5:
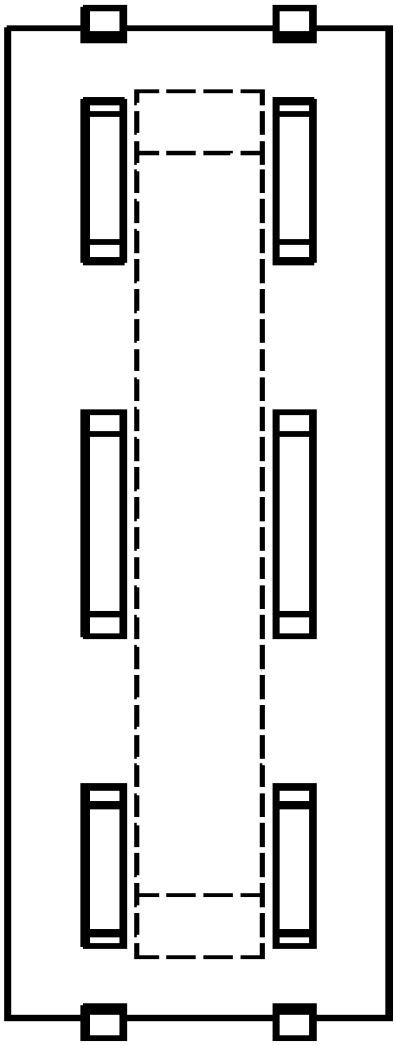
FIG. 5 is a top view thereof.
Figure 6:
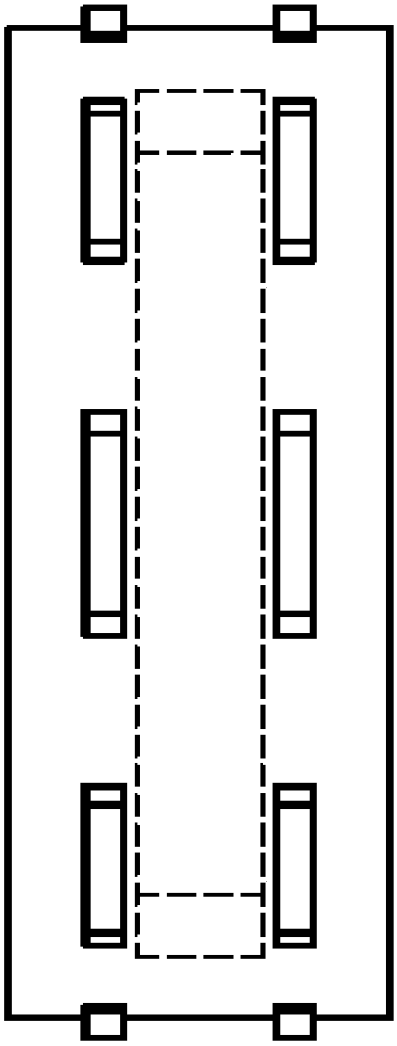
FIG. 6 is a bottom view thereof.
Figure 7:
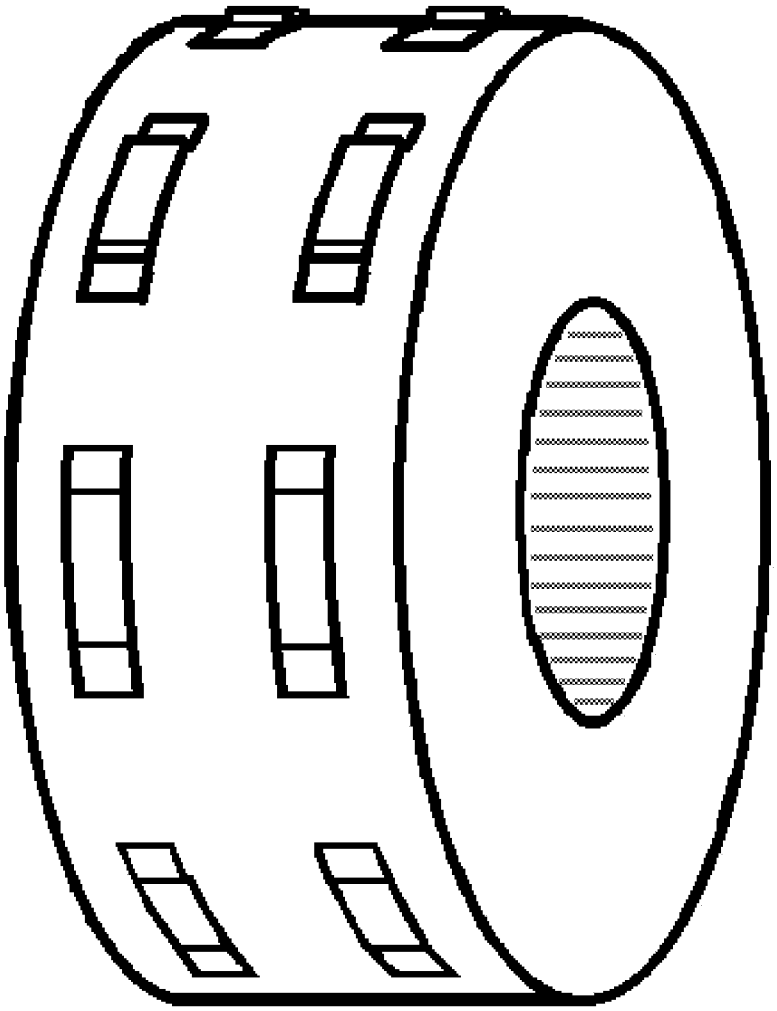
FIG. 7 is an isometric view thereof.
Figure 8:
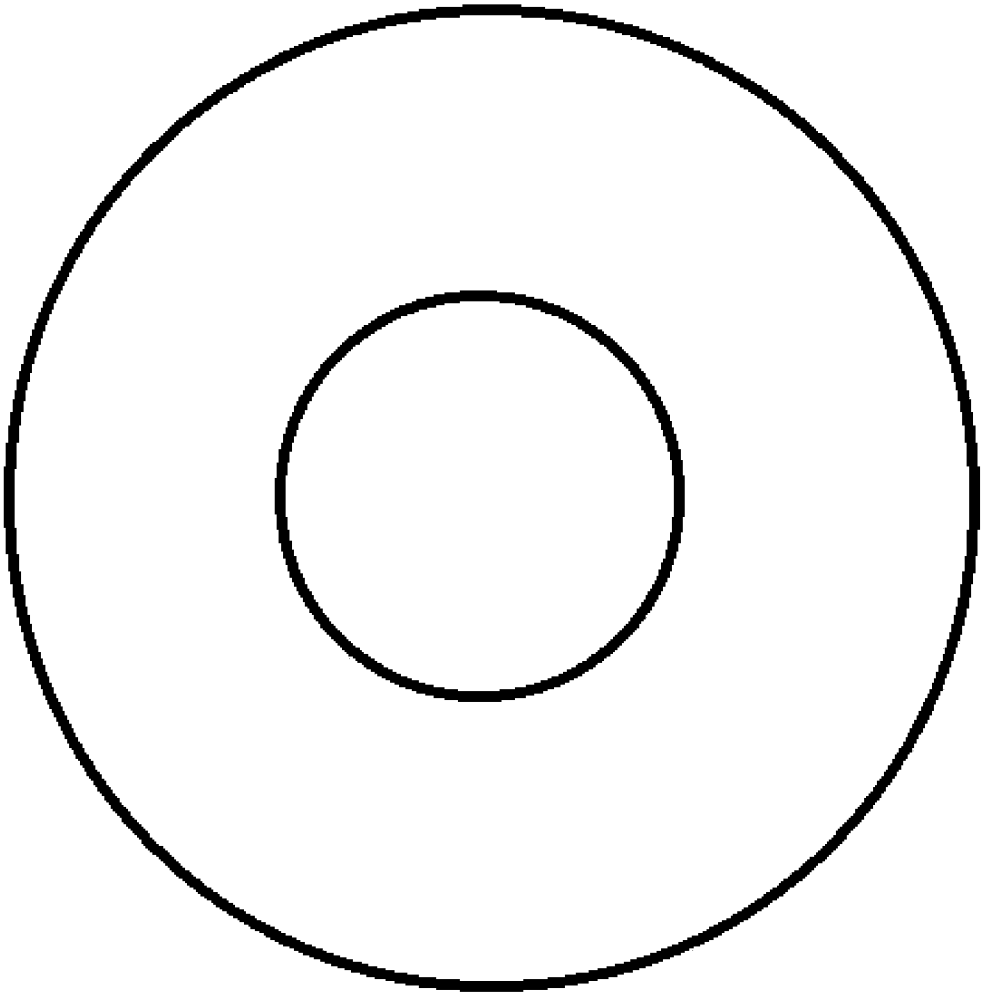
FIG. 8 is a front view of a core portion thereof.
Figure 9:
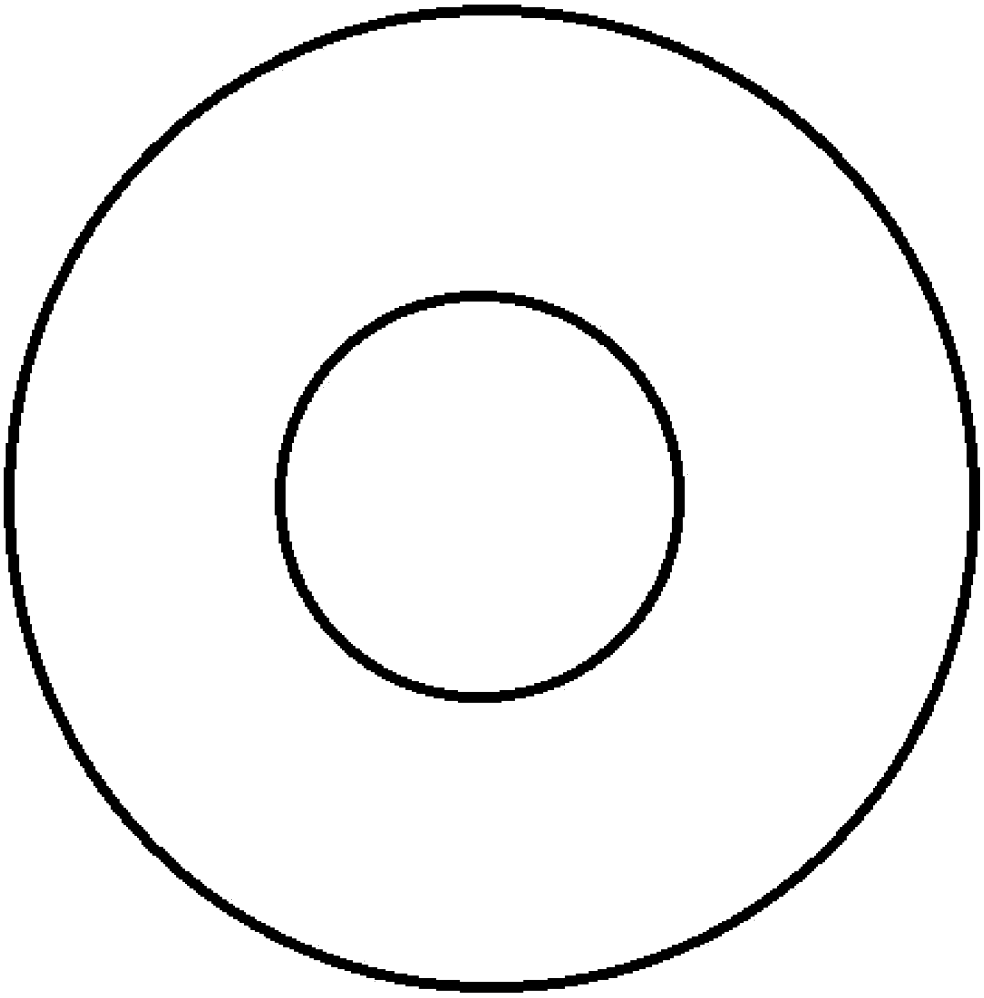
FIG. 9 is a rear view of a core portion thereof.
Figure 10:
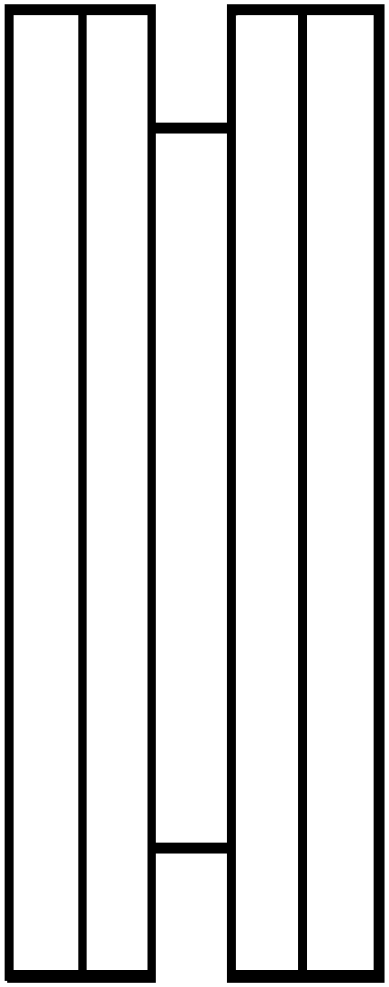
FIG. 10 is a first side view of a core portion thereof.
Figure 11:
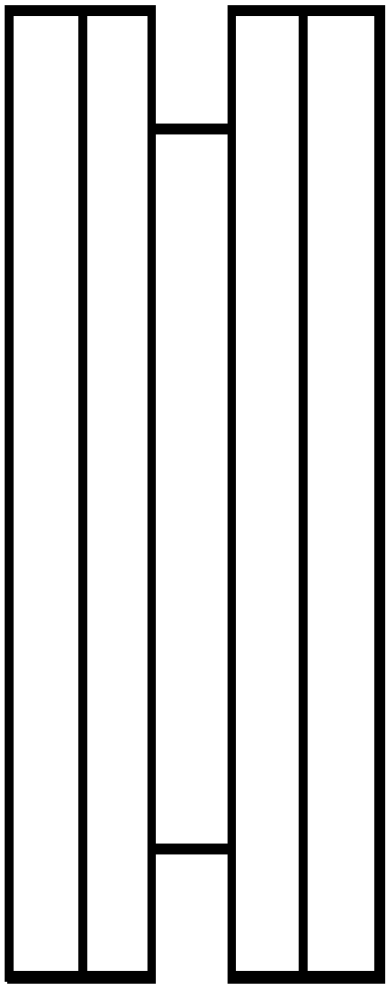
FIG. 11 is a second side view of a core portion thereof.
Figure 12:
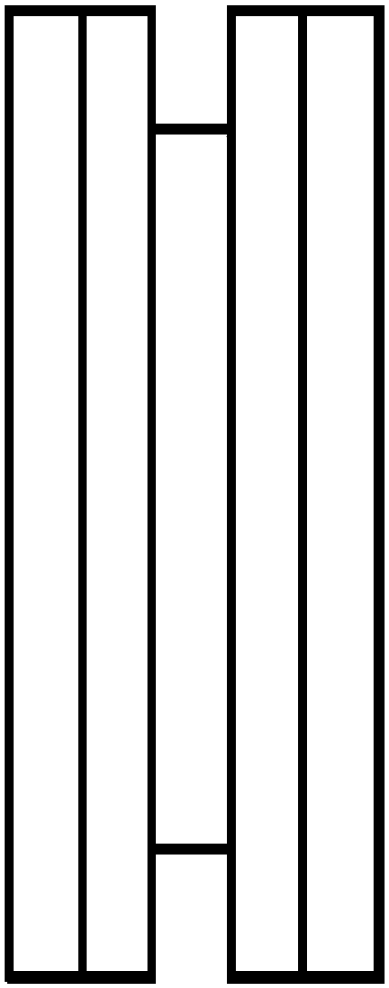
FIG. 12 is a top view of a core portion thereof.
Figure 13:
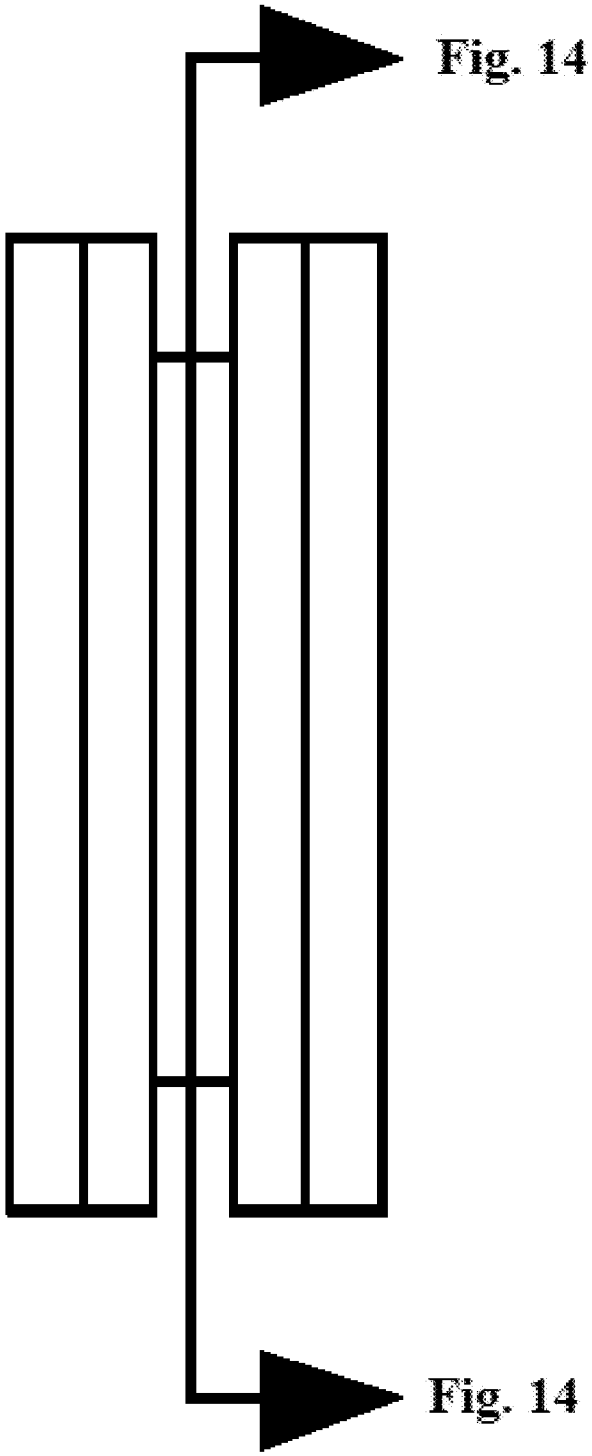
FIG. 13 is a bottom view of a core portion thereof.

For purposes of illustration, and not limitation, a first embodiment of a functional training ring in accordance with the disclosure is presented in FIG. 1. The training ring, as depicted, is a weighted ring that can be used as a training aid in various sports, such as basketball, or any other suitable sport or training routine, as desired, where strength and power conditioning is sought. The disclosed embodiments permit strength coaches to have the benefits of having their athletes flip a tractor tire on a basketball court, for example, but avoid risks of damaging the surface of the court.

The ring, as depicted, includes a composite structure foam core 1 surrounded by a fabric cover, or skin 3, that is sewn onto the ring via stitching. The cover includes two rows of eight handles 4 around the periphery of the ring. The handles 4 are preferably formed from nylon strapping that is 1, 1.5 or two inches wide and between about 8 and 14 inches long. The foam core includes a central cavity that includes a weighted tube 2 that is surrounded by a radially outward ring-shaped foam cap.

The foam core 1 can be seen in detail in FIGS. 10-14. As presented, the foam core is formed from a multilayer assembly of parallel foam panels that are attached to each other, for example, by a compatible foam adhesive. The foam layers (five in the illustrated embodiment) are preferably somewhat rigid, rather than soft, to permit the ring to be used as a pylo box wherein a user can jump from the floor, onto the ring and back down, or even use the ring as a platform for doing movements that benefit from being elevated, such as stiff legged deadlifts, and the like. The foam can be, for example, a closed cell crosslinked polyether foam sheet that is cut to shape. Preferably, the foam is sandwiched in layers as disclosed to function in a manner similar to a multilayered composite beam in order to enhance stiffness. Alternatively, the foam can be molded as a unitary member.

The foam can have a nominal density (in accordance with ASTM D3575) between about 25 and 50 kg/m$^3$, any value between said values in increments of 0.5 kg/m$^3$, inclusive of the endpoints of said range, or within any subrange therein of about 2.0 kg/m$^3$, inclusive of the endpoints of said range.

The foam can have a tensile strength, in some embodiments, (in accordance with ASTM D412) between about 200 and 500 kPa, any value between said values in increments of 1.0 kPa, inclusive of the endpoints of said range, or within any subrange therein of about 10 kPa, inclusive of the endpoints of said range.

The foam can have an elongation at break, in some embodiments, (in accordance with ASTM D412) between about 150 and 300%, any value between said values in increments of 1.0%, inclusive of the endpoints of said range, or within any subrange therein of about 5%, inclusive of the endpoints of said range.

The foam can have a tear resistance, in some embodiments, (in accordance with ASTM D624) between about 150 and 300%, any value between said values in increments of 1.0%, inclusive of the endpoints of said range, or within any subrange therein of about 5%, inclusive of the endpoints of said range.

The foam can have a Shore OO hardness, or durometer, in some embodiments, (in accordance with ASTM D2240) between about 40 and about 70 any value between said values in increments of about 0.5, inclusive of the endpoints of said range, or within any subrange therein of about 5, inclusive of the endpoints of said range.

The foam can have a compression set within particular ranges. The compression set of a material is the permanent deformation remaining when a force that was applied to it is removed after a set period of time. Compression set represents the percentage of the original deflection that did not return within the set time period. Thus, the foam, in some embodiments, can have a 50% compression set (in accordance with ASTM D3575, Suffix B) between about 25% and about 40% one half hour after the force is removed, or any value between said values in increments of about 1.0%, inclusive of the endpoints of said range, or within any subrange therein of about 5.0%, inclusive of the endpoints of said range. The foam can additionally or alternatively have a 50% compression (in accordance with ASTM D3575, Suffix B) after 24 hours between about 25% and about 40%, or any value between said values in increments of about 1.0%, inclusive of the endpoints of said range, or within any subrange therein of about 5.0%, inclusive of the endpoints of said range.

The foam can have a compressive strength within particular ranges. The compressive strength of the foam material, as set forth herein, is expressed in kPa based on a certain percent compression (in accordance with ASTM D3575, Suffix D). The foam can thus have a compressive strength at 25% compression between about 45 kPa and about 75 kPa, or any value between said values in increments of about 1.0 kPa, inclusive of the endpoints of said range, or within any subrange therein of about 5.0 kPa, inclusive of the endpoints of said range. The foam can additionally or alternatively have a compressive strength at 50% compression between about 95 kPa and about 155 kPa, or any value between said values in increments of about 1.0 kPa, inclusive of the endpoints of said range, or within any subrange therein of about 5.0 kPa, inclusive of the endpoints of said range.

The foam can have a working temperature range between about 40 and 100 degrees Centigrade. The foam is preferably hydrophobic and has a water absorption after seven days less than about 3 weight percent of the foam, more preferably less than about 2 weight percent, most preferably less than about 1 weight percent.

Figure 14:
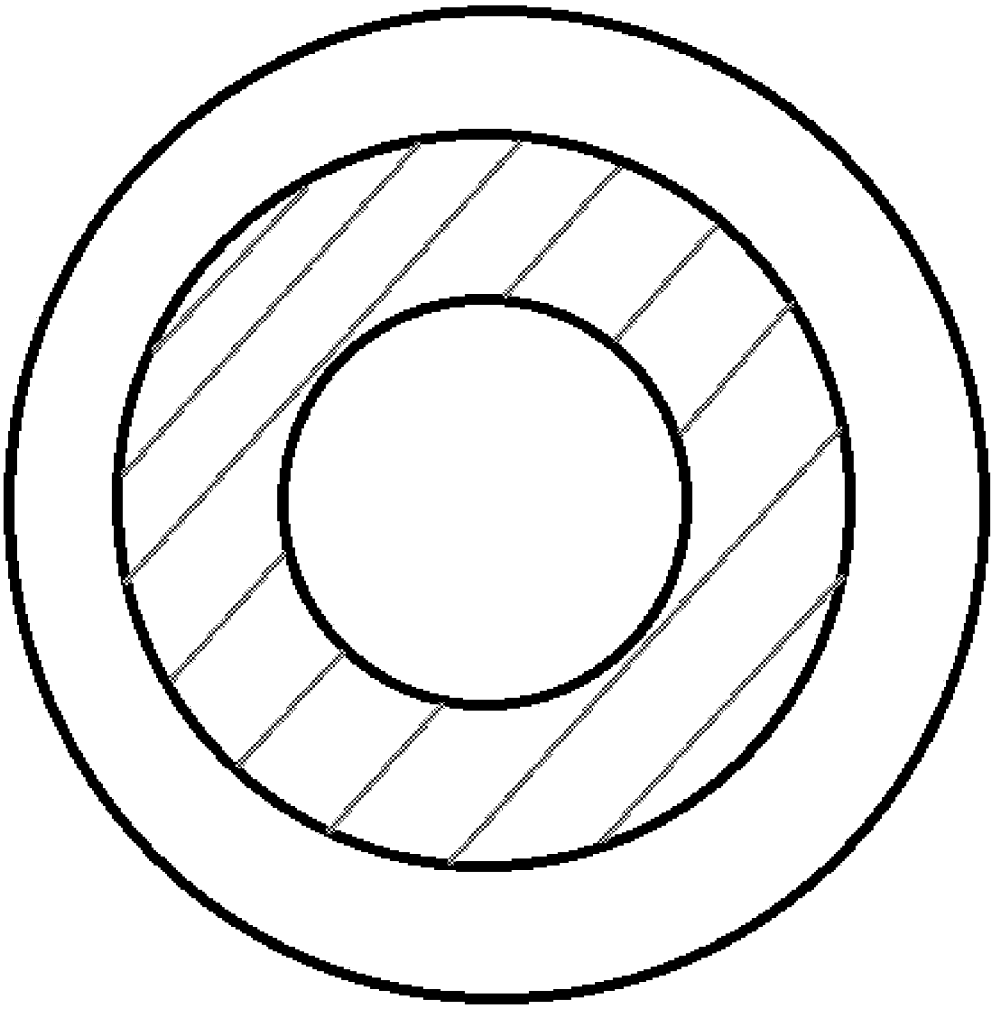
FIG. 14 is a cross-sectional view of a core portion thereof to show the contour of a radially inwardly located outwardly facing surface.

FIG. 14 illustrates a cross sectional view of the foam core showing a radially inner region in cross-hatching that bounds a circular surface that the weighted tube 2 rests against. The weighted tube can be, for example, a fabric tube with a rounded or rectangular cross section filled with a suitable dense material, such as silica sand, metal shot (spheres), gel, and the like. The weighted tube is preferably secured to itself (end to end) by a re-fastenable fastener (e.g., hook and loop fastener), tape, and the like. The weighted tube can be made of any desired material such as vinyl-coated fabric. The weighted tube is further prevented from radial outward movement by way of an annular foam strip, or cap, that surrounds the weighted tube and is secured in place, for example, by foam adhesive, two-sided tape, and the like. The annular foam strip is preferably cut from the same foam material as the rest of the core 2. The annular foam strip provides a substantially constant hardness along the outer wall of the training ring.

When assembled, the core presents an annular shape with smooth sides that is then surrounded with fabric. During assembly, panels of fabric 3 that are annular (for the front and back) and rectangular (for the outer and inner side surfaces) are stitched together and the foam body 2 is inserted, and sealed inside by stitching. The fabric planar faces can include vinyl coated polyester or other suitable material having a basis weight between about 10 and about 24 oz. per square yard in increments of 1 oz. per square yard, more preferably between about 14 and 18 oz. per square yard.

In one implementation, the ring has a 48" outer diameter, a 20" inner diameter, a thickness, or depth, of about 15 inches, and a weight of about 140 lbs. In another implementation, the ring has a 48" outer diameter, a 22" inner diameter, a thickness, or depth, of about 18 inches, and a weight of about 175 lbs. However, it will be appreciated that the dimensions can be different. For example, the outer diameter of the ring can be between about 36 and about 72 inches (for very tall users, such as in a strongman competition), and in about one inch increments therebetween. The inner diameter can be between about 12 and about 36 inches, and in about one inch increments therebetween. The depth, or thickness, of the ring can be between about 10 and 30 inches, and in about one inch increments therebetween. The ring can weigh between about 50 pounds and about 500 or more pounds (e.g., for strongman competitions) and in any increment therebetween of about one pound. It will be further appreciated that the inner hole may be absent, or may be a shape other than a circle, such as a hexagon, triangle, square, pentagon, octagon, and the like. It will likewise be understood that while the outer surface of the ring is circular, it may alternatively be slightly elliptical, or may be a polygon such as one having 6, 7, 8, 9, 10, 11, 12 or more sides.

Advantageously, the disclosed embodiments can be used both as a plyo box and a flipping tire. Thus, any desired drill can be performed with the ring as with a tire, but may be done indoors. Various other drills can be practiced with multiple rings, such as stacking the rings on top of one another and if desired, around a post, such that the athlete has to completely lift the ring off the ground and around the post, or remove the ring from around the post, or lifting the ring onto or off of a platform of a desired height.

The handles are provided in two rows so that when the ring lays on its side, an athlete can grip the ring at a higher or lower elevation. If provided, the inner hole can permit an athlete to do a drill wherein the athlete jumps into and out of the ring. The foam, as indicated in preferably stiff so that a user can jump from the ground to the top of the ring as with a pylo box.

Thus, the ring can be flipped along the ground or floor, end over end, as desired, in some implementations. Alternatively, it can be pushed or pulled along the ground or floor to work different muscle groups. For example, a user can push the ring, or pull it by the handles. Or, the user can strap on a harness and connect it to the handles on the ring and pull the ring like a weight sled. The ring can be rolled back and forth between two users along the floor, similar to a medicine ball. But, unlike a tire, the ring, having a flat outer face, is much less likely to fall over or roll out of control as compared to a large agricultural tire.

The following examples are provided as different drills that can be done with the ring.

1. Lay the ring flat on its side, stand on top of the ring and jump off to "stick the landing". This is a test of knee stabilization and balance.

2. Lay the ring flat on its side like a box. Face the ring with your feet shoulder-width apart. Squat down slightly, as if you're going to jump straight into the air. Your arms will naturally swing backwards and return forward as you leap onto the ring. This is a functional exercise that can help improve an athlete's explosiveness for running and increase their vertical jump. As their vertical jump improves, they can test themselves by using thicker rings or stacking one ring on top of another.

3. Facing away from the ring, place your arms behind you. Rest the palms of your hands on the ring with your arms fully extended. Place your feet approximately half of your body length in front of the ring. This will be your starting position. Bend at the elbows into a 90-degree angle while lowering your body slowly until your bottom almost touches the ground. Return to a straight-arm position. This is one full repetition. This is similar to a bench dip—it's a slow, controlled movement to work your triceps. If the movement is too easy, add a plate to your lap or use it as an "active rest" in between other ring-based exercises. If desired, two rings can be stacked on top of each other permitting use of the handles or upper surface of the upper ring to change the angle of training.

Figure 15:
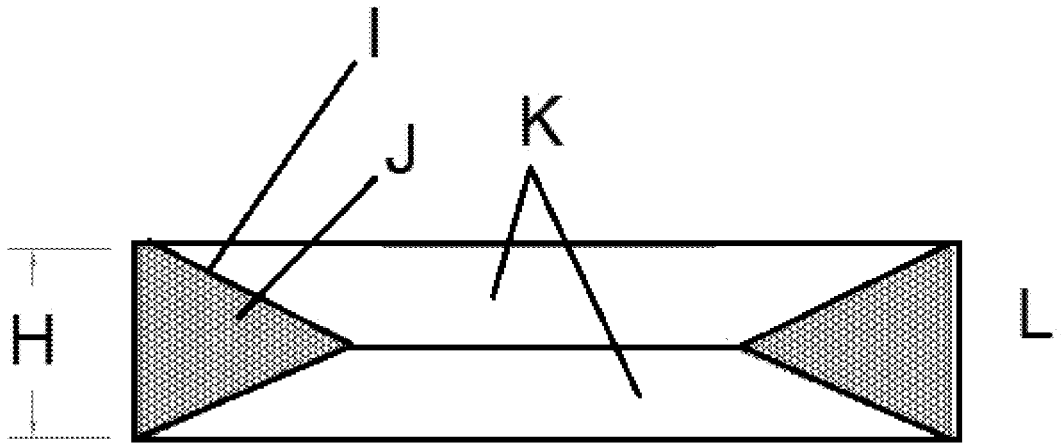
FIGS. 15-17 illustrate variations of the cross sectional shape of an illustrative functional training ring.
Figure 16:
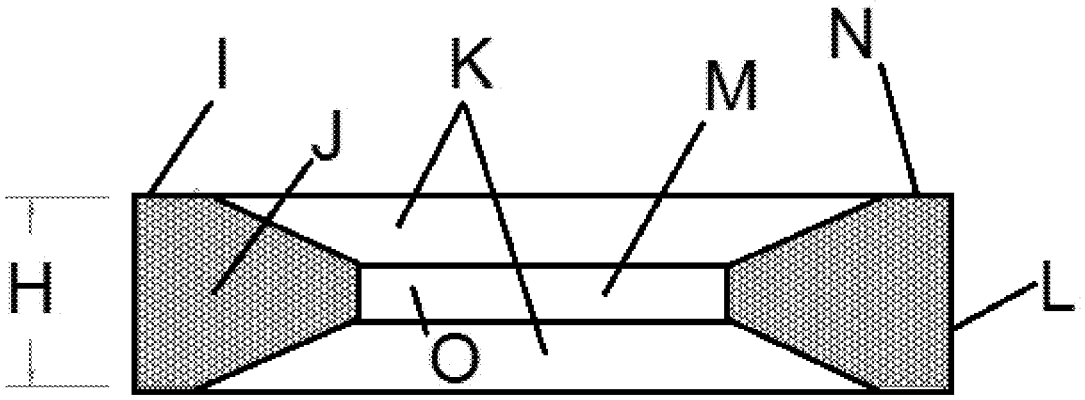
Figure 17:
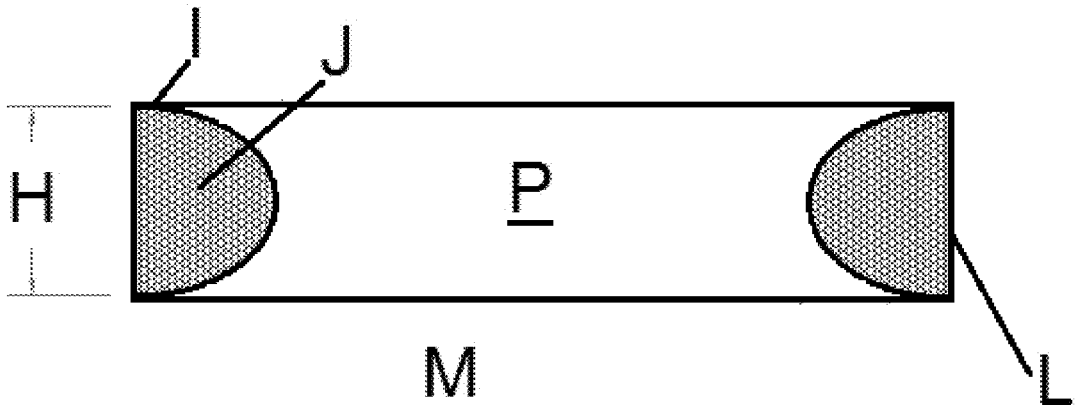

As can be seen in the figures, the cross section of the device is rectangular, and can be square. In alternative embodiments (FIGS. 15-17), however, the cross section can have different shapes. For example, as illustrated in FIG. 15, the cross section can have a triangular shape wherein faces N, N are replaced by conically shaped faces K, K, and surface O is eliminated. FIG. 16 illustrates an embodiment having a trapezoidal cross section, adding panels K, K that connect panels N, N to inner annular panel, O. FIG. 17 presents a further alternative embodiment that connects a curved inner panel (or series of attached panels) P to outer panel L. It is preferred that panel L be kept generally flat across its cross section to ensure maximum ground contact, but also to ensure that the ring will roll in a straight line when used. However, it is also contemplated that panel L could be tilted slightly such that the outer surface of the device defines a conic section so as to cause the ring to curve slightly in one direction when rolled. Moreover, instead of being flat, surface L could be slightly convex or concave, or have a non-uniform cross section (e.g., undulating or serpentine), such as a tread, as long as the device rolls as intended in use.

The methods and systems of the disclosed embodiments, as described above and shown in the drawings, provide for equipment and related techniques with superior attributes. It will be apparent to those skilled in the art that various modifications and variations can be made in the devices and methods of the disclosed embodiments without departing from the spirit or scope of the disclosure. Thus, it is intended that the disclosure include modifications and variations that are within the scope of the appended claims and their equivalents.

What is claimed is:

1. A method of plyometrics training, comprising:

a) providing a training device having dimensions that simulate the height and dimensions of an agricultural type tire, the device including a generally cylindrical structure defined by front and back fabric planar non-marking faces configured to avoid leaving markings on a floor of an exercise area, said faces being connected and intersected by an outer annular fabric planar wall to define and surround a generally cylindrical volume, the generally cylindrical volume being filled with a monolithic, substantially rigid foam body that fully surrounds an annularly-shaped weight disposed within the foam body, the training device having a rectangular cross-section, wherein:

i) the training device is defined by an outer planform lateral dimension and a thickness defined by the distance between the front and back faces;

ii) the outer planform lateral dimension is between about 36 inches and about 72 inches; and iii) the thickness is between about 10 inches and about 30 inches; and b) performing a plyometrics exercise drill using the training device.

2. The method of claim 1, wherein the training device is further provided with a plurality of handles attached to the outer annular fabric planar wall, and further wherein the method includes flipping the training device end over end by gripping the handles, and lifting the ring from a flat position onto the floor up onto its side, and then pushing the ring down onto the ground.

3. The method of claim 1, wherein the method is practiced on a polished gymnasium floor.

4. The method of claim 1, herein the method further includes laying the training device flat on a floor, and repeatedly jumping from the floor up onto the training device, and off of the training device onto the floor.

5. The method of claim 1, further comprising providing a plurality of said training devices and stacking them flat on top of each other on a surface.

6. The method of claim 1, wherein the training device is an annular ring structure defining a central opening therethrough, wherein the central opening has a lateral dimension between about 12 and 36 inches.

7. The method of claim 6, wherein the training device weighs between about 50 pounds and about 500 pounds.

8. The method of claim 6, wherein the central opening is non-circular.

9. The method of claim 6, wherein the central opening is circular and the device is circular, occupying a toroidal volume.

10. The method of claim 9, wherein the substantially rigid foam body defines an annular cavity therein that contains the annularly-shaped weight.

11. The method of claim 9, wherein the substantially rigid foam body is formed from a plurality of layers of substantially rigid foam material.

12. The method of claim 6, further comprising laying the training device down on a surface, and engaging in a drill that includes standing on the surface at a location outside of the training device, and jumping over a peripheral region of the training device into the central opening of the training device, and the jumping over the peripheral region of the training device to the location outside of the training device.

13. The method of claim 1, wherein the annularly shaped weight disposed within the foam body includes an outer envelope filled with a flowable material.

14. A training device, comprising:

a) a generally cylindrical body having dimensions that simulate those of an agricultural type tire, the device including a generally cylindrical structure defined by front and back fabric planar non-marking faces configured to avoid leaving markings on a floor of an exercise area, said faces being connected and intersected by an outer annular fabric planar wall to define and surround a generally cylindrical volume, the generally cylindrical volume being filled with a monolithic, substantially rigid foam body that fully surrounds an annularly-shaped weight disposed within the foam body, the training device having a rectangular cross-section, wherein:

i) the training device is defined by an outer planform lateral dimension and a thickness defined by the distance between the front and back faces;

ii) the outer planform lateral dimension is between about 36 inches and about 72 inches; and iii) the thickness is between about 10 inches and about 30 inches; and iv) the training device further includes a plurality of handles attached to the outer annular fabric planar wall disposed about a circumference of the training device.

15. The training device of claim 14, wherein the training device is an annular ring structure defining a central opening therethrough, wherein the central opening has a lateral dimension between about 12 and 36 inches.

16. The training device of claim 14, wherein the training device weighs between about 50 pounds and about 500 pounds.

17. The training device of claim 14, wherein the central opening is non-circular.

18. The training device of claim 14, wherein the central opening is circular and the device is circular, occupying a toroidal volume.

19. The training device of claim 14, wherein the substantially rigid foam body defines an annular cavity therein that contains the annularly shaped weight.

20. The training device of claim 19, wherein the substantially rigid foam body is formed from a plurality of layers of substantially rigid foam material.

* * * * *